US011036162B1

(12) United States Patent
Tamazawa et al.

(10) Patent No.: US 11,036,162 B1
(45) Date of Patent: Jun. 15, 2021

(54) POWDER TRANSPORT APPARATUS

(71) Applicant: FUJIFILM Business Innovation Corp., Tokyo (JP)

(72) Inventors: Norihiro Tamazawa, Kanagawa (JP); Tomoyuki Yoshii, Kanagawa (JP); Yoshitaka Nakajima, Kanagawa (JP); Kenta Urayama, Kanagawa (JP); Yoshifumi Ozaki, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/877,894

(22) Filed: May 19, 2020

(30) Foreign Application Priority Data

Dec. 4, 2019 (JP) ..... JP2019-219972

(51) Int. Cl.
*G03G 15/08* (2006.01)
*G03G 15/02* (2006.01)

(52) U.S. Cl.
CPC ..... *G03G 15/0817* (2013.01); *G03G 15/0241* (2013.01); *G03G 15/0822* (2013.01); *G03G 15/0889* (2013.01)

(58) Field of Classification Search
CPC ..... G03G 15/0241; G03G 15/0817; G03G 15/0822; G03G 15/0887; G03G 15/0889; G03G 15/0891
See application file for complete search history.

(56) References Cited

U.S. PATENT DOCUMENTS

| | | | | |
|---|---|---|---|---|
| 9,348,263 | B2 | 5/2016 | Iketani et al. | |
| 2010/0196057 | A1 | 8/2010 | Mihara et al. | |
| 2012/0177412 | A1* | 7/2012 | Watanabe ..... | G03G 15/0189 399/256 |

FOREIGN PATENT DOCUMENTS

| | | | |
|---|---|---|---|
| JP | 2010-176074 | A | 8/2010 |
| JP | 6204286 | B2 | 9/2017 |

* cited by examiner

*Primary Examiner* — Hoang X Ngo
(74) *Attorney, Agent, or Firm* — Sughrue Mion, PLLC

(57) ABSTRACT

A powder transport apparatus includes a housing and first and second transport members. The housing includes first and second transport paths that are separated by a partition wall extending in one direction. The first and second transport paths are connected by first and second connection ports. The first and second connection ports are separated in the one direction with the partition wall interposed therebetween. The first transport member is provided in the first transport path. The first transport member transports powder. The second transport member is provided in the second transport path. The second transport member transports the powder. A transport force of the second transport member at a portion of the second transport member where the second transport member faces the first connection port is smaller than a transport force of the second transport member at a portion where the second transport member faces the partition wall.

18 Claims, 4 Drawing Sheets

POWDER TRANSPORT APPARATUS

CROSS-REFERENCE TO RELATED APPLICATIONS

This application is based on and claims priority under 35 USC 119 from Japanese Patent Application No. 2019-219972 filed Dec. 4, 2019.

BACKGROUND

1. Technical Field

The present disclosure relates to a powder transport apparatus.

2. Related Art

JP-A-2010-176074 discloses a developing device. The developing device includes a developer accommodating unit that accommodates a developer containing toner and a magnetic carrier, a developer transport path through which the developer is transported inside the developer accommodating unit, a developer transport member that is provided in the developer transport path and transports the developer towards a predetermined direction while agitating the developer, and a developing roller that carries the developer in the developer transport path and supplies the toner contained in the developer to a photoconductor drum. The developer transport member includes a rotation shaft and a spiral blade provided on an outer periphery of the rotation shaft. The spiral blade is configured with a multiplex spiral structure that includes one or more ring-shaped spiral blades having a large outer diameter and one or more spiral blades having a small outer diameter. A spiral pitch of the ring-shaped spiral blade having the large outer diameter is the same as a spiral pitch of the spiral blade having the smaller outer diameter.

SUMMARY

Aspects of non-limiting embodiments of the present disclosure relate to preventing powder from accumulating in a first connection port as compared with a powder transport apparatus in which a transport force of a second transport member at a portion of the second transport member where the second transport member faces the first connection port is the same as a transport force of the second transport member at a portion of the second transport member where the second transport member faces a partition wall.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a powder transport apparatus including a housing, a first transport member, and a second transport member. The housing includes a first transport path and a second transport path that are separated by a partition wall extending in one direction. The first transport path and the second transport path are connected to each other by a first connection port and a second connection port. The first connection port and the second connection port are separated in the one direction with the partition wall interposed therebetween. The first transport member is provided in the first transport path. The first transport member is configured to transport powder in a direction extending from the first connection port towards the second connection port. The second transport member is provided in the second transport path. The second transport member is configured to transport the powder in a direction extending from the second connection port towards the first connection port. A transport force of the second transport member at a portion of the second transport member where the second transport member faces the first connection port is smaller than a transport force of the second transport member at a portion where the second transport member faces the partition wall.

BRIEF DESCRIPTION OF THE DRAWINGS

Exemplary embodiment(s) of the present disclosure will be described in detail based on the following figures, wherein.

DETAILED DESCRIPTION

An example of a developing device and an image forming apparatus according to an exemplary embodiment of the present disclosure will be described with reference to the drawings.

In the following description, in a front view of an image forming apparatus 10 when viewed from a side where a user (not illustrated) stands, apparatus upper and lower directions (vertical directions) is described as H directions, apparatus width directions (horizontal directions) is described as W directions, apparatus depth directions (horizontal directions) is described as D directions. When one side and the other side of each of the apparatus upper and lower directions, the apparatus width directions, and the apparatus depth directions need to be distinguished from each other, an upper side is described as a +H side, a lower side is described as a −H side, a right side is described as a +W side, a left side is described as a −W side, a far side is described as a +D side, and a near side is described as a −D side in the front view of the image forming apparatus 10.

Image Forming Apparatus 10

Figure 1:
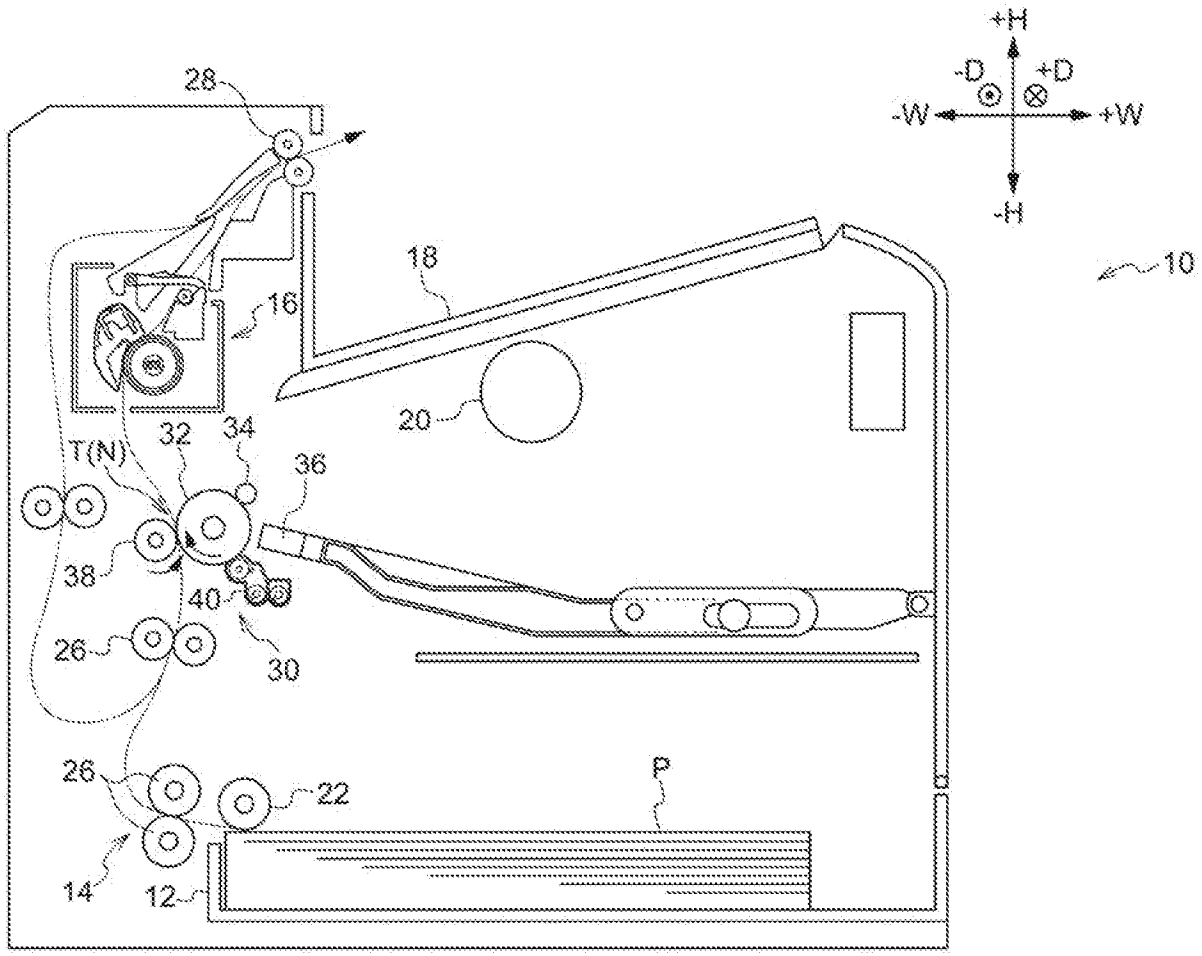
FIG. 1 is a front view illustrating an image forming apparatus according to an exemplary embodiment.

The image forming apparatus 10 according to the exemplary embodiment is a monocolor image forming apparatus that forms and fixes a monochrome toner image on a sheet member P which is an example of a recording medium. As illustrated in FIG. 1, the image forming apparatus 10 includes an accommodating unit 12, a discharge unit 18, a transport unit 14, an image forming unit 30, a fixing unit 16, and a toner cartridge 20. The image forming apparatus according to the exemplary embodiment of the present disclosure is not limited to the monocolor image forming apparatus. For example, the image forming apparatus according to the exemplary embodiment of the present disclosure may be a color image forming apparatus that expresses colors by combining two or more colors, such as four colors of yellow (Y), magenta (M), cyan (C), and black (K).

The accommodating unit 12 has a function of accommodating the sheet members P.

The sheet member P on which an image is formed by the image forming unit 30 and fixed by the fixing unit 16 is discharged to the discharge unit 18.

The transport unit 14 has a function of transporting the sheet member P accommodated in the accommodating unit 12 to a transfer position T where an image is to be formed by transfer. The transport unit 14 further has a function of transporting the sheet member P on which the image is fixed by the fixing unit 16, which will be described later, to the discharge unit 18 to discharge the sheet member P.

The image forming unit 30 has a function of forming an image on the sheet member P by an electrophotographic process. Specifically, the image forming unit 30 includes a photoconductor drum 32, a charging roller 34, an exposure device 36, a developing device 40 (an example of a powder transport apparatus), and a transfer roller 38. The photoconductor drum 32 is an example of an image carrier that carries a latent image. The charging roller 34 is an example of a charging device that charges the photoconductor drum 32. The exposure device 36 exposes the photoconductor drum 32 charged by the charging roller 34 to form an electrostatic latent image (an example of a latent image) on the photoconductor drum 32. The developing device 40 develops the electrostatic latent image formed on the photoconductor drum 32 by the exposure device 36 into a toner image using a developer G (an example of powder) that contains toner. The developer G is accommodated in the developing device 40. The developing device 40 will be described later in detail.

The transfer roller 38 faces and is in contact with the photoconductor drum 32. A nip region N which is an example of the transfer position T is formed between the transfer roller 38 and the photoconductor drum 32. The transfer roller 38 and the photoconductor drum 32 sandwich the sheet member P transported to the nip region N by the transport unit 14 while the transfer roller 38 is rotated, so as to transfer the toner image formed on the photoconductor drum 32 to the sheet member P and transport the sheet member P to the fixing unit 16. As illustrated in FIG. 1, the transfer roller 38 is rotated counterclockwise and the photoconductor drum 32 is rotated clockwise at this time as viewed from the front side in the exemplary embodiment. The transfer roller 38 is an example of a transfer unit and transfers the toner image formed on the photoconductor drum 32 to the sheet member P.

In the present exemplary embodiment, the fixing unit 16 is a fixing device that fixes the toner image, which is transferred to the sheet member P by the transfer roller 38, onto the sheet member P by heating and pressurizing the sheet member P.

The toner cartridge 20 accommodates the developer G that contains the toner and a magnetic carrier. The toner cartridge 20 is connected with a second transport path 54 of the developing device 40 (which will be described later) by a supply path (not illustrated). When the toner is consumed in the developing device 40 by a development operation of the developing device 40, the toner cartridge 20 supplies the developer G to the second transport path 54 of the developing device 40.

Developing Device 40

Next, the developing device 40 will be described.

Figure 2:
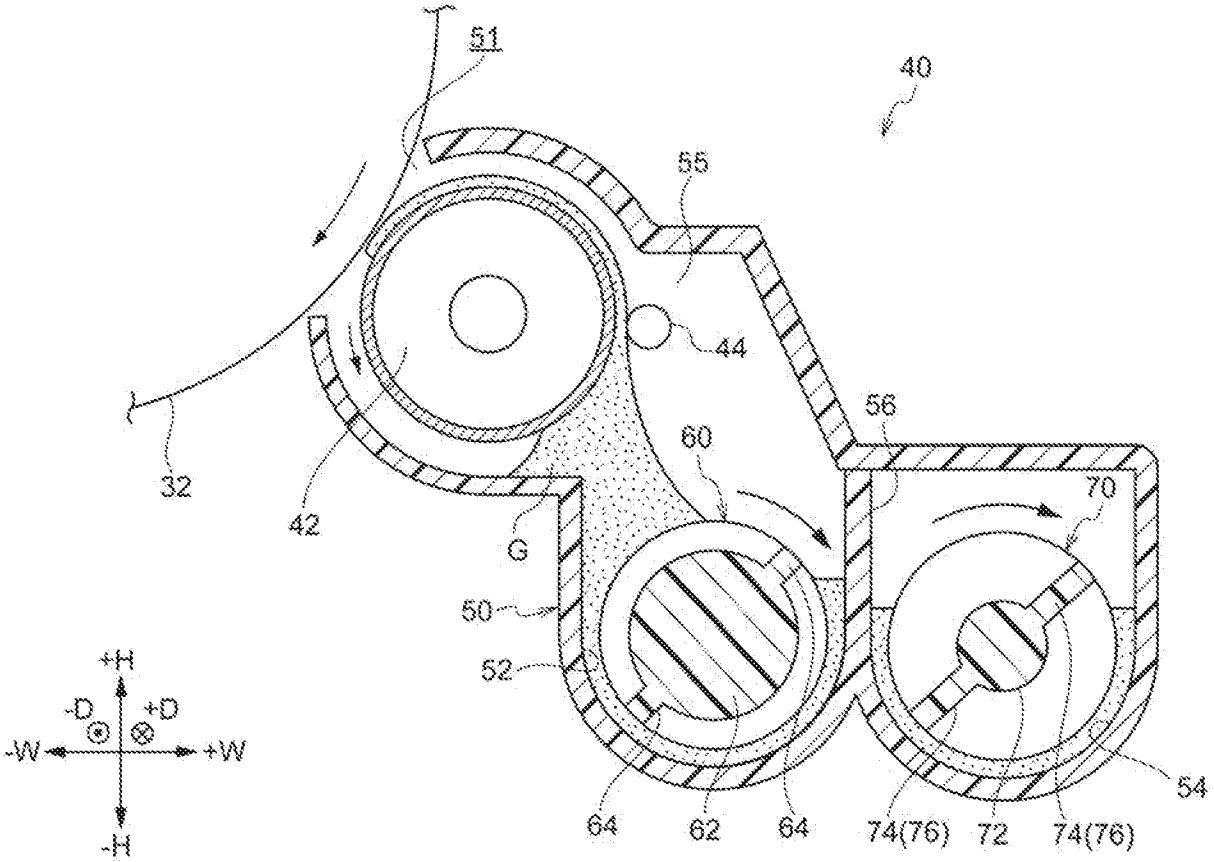
FIG. 2 is a front cross-sectional view illustrating a developing device according to the exemplary embodiment.
Figure 3:
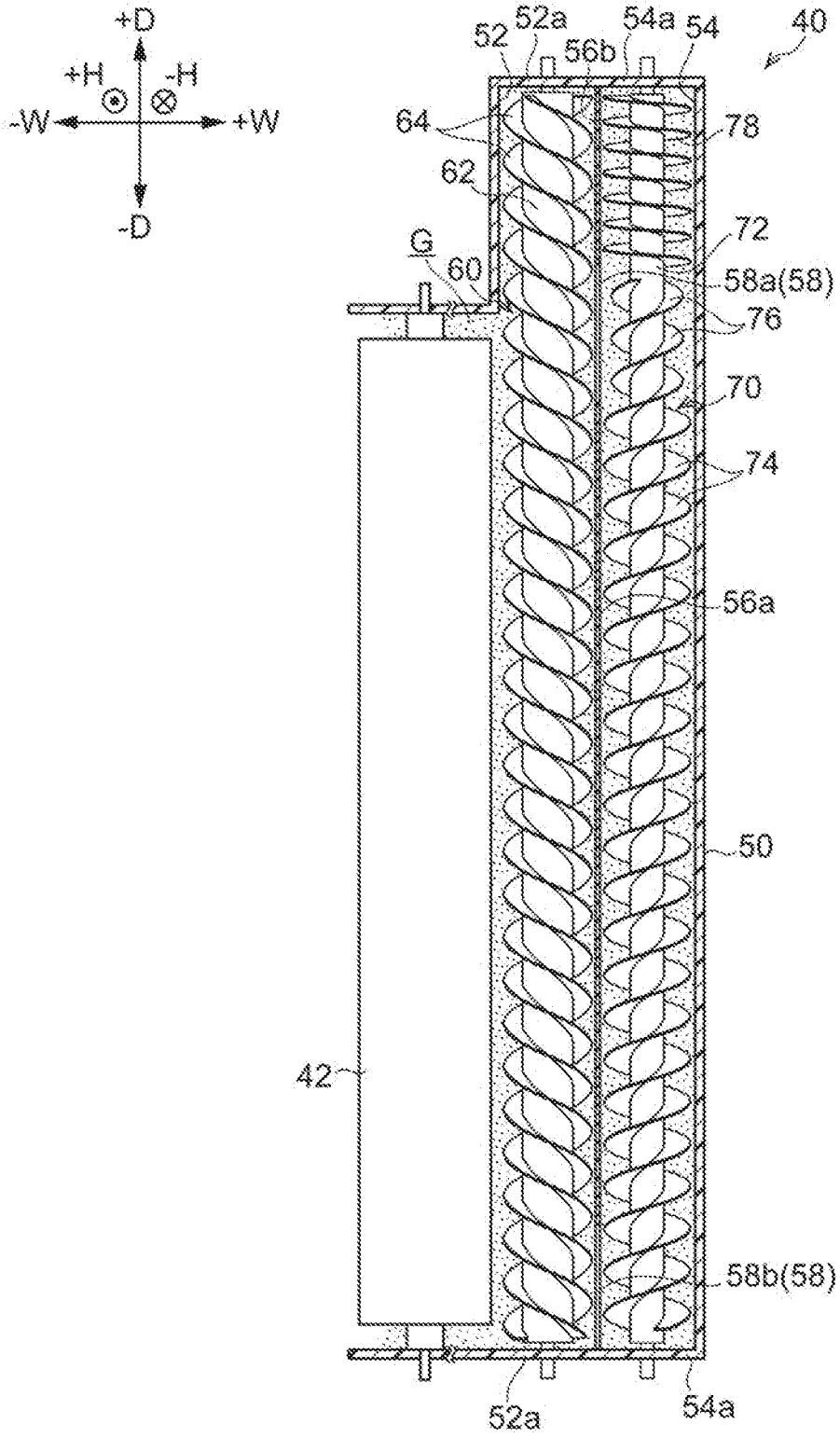
FIG. 3 is a plan cross-sectional view illustrating the developing device illustrated in FIG. 2.

As illustrated in FIGS. 2 and 3, the developing device 40 extends in the apparatus depth directions and includes a housing 50, a developing roller 42, a layer regulating member 44, a first transport member 60, and a second transport member 70. In the exemplary embodiment, the developing device 40 is disposed at the −H side and the +W side of the photoconductor drum 32. The housing 50 accommodates the developer G therein.

As illustrated in FIG. 3, the housing 50 includes a bottom wall extending in the apparatus depth directions in a plan view, a peripheral wall standing at the +H side of a periphery of the bottom wall, and a first partition wall 56*a* and a second partition wall 56*b*. The first partition wall 56*a* and the second partition wall 56*b* stand at a center portion of the bottom wall in the apparatus width directions towards the +H side and extend in the apparatus depth directions. The first partition wall 56*a* and the second partition wall 56*b* stand while arranged side by side in the apparatus depth directions. The first partition wall 56*a* stands at the −D side, and the second partition wall 56*b* stands at the +D side. The first partition wall 56*a* and the second partition wall 56*b* will be described later in detail. As illustrated in FIG. 2, a cross section of the bottom wall as viewed from the front side has such a shape that two semicircle arc portions open towards the +H side and are arranged adjacent to each other in the apparatus width direction. The first partition wall 56*a* and the second partition wall 56*b* stand at a boundary portion between the two semicircle arc portions. A space defined by the bottom wall and the peripheral wall of the housing 50 is divided into a first transport path 52 and a second transport path 54 in the apparatus width directions by the first partition wall 56*a* and the second partition wall 56*b*. In the exemplary embodiment, a space at the −W side of the first partition wall 56*a* and the second partition wall 56*b* serves as the first transport path 52, and a space at the +W side of the first partition wall 56*a* and the second partition wall 56*b* serves as the second transport path 54. That is, the first transport path 52 and the second transport path 54 are separated by the first partition wall 56*a* and the second partition wall 56*b*. The first transport path 52 and the second transport path 54 accommodate the developer G. End walls at both sides of the peripheral wall in the apparatus depth directions serve as bearing portions that rotatably support a shaft body 62 of the first transport member 60 and a shaft body 72 of the second transport member 70. The first transport member 60 and the second transport member 70 (which will be described later) are respectively provided in the first transport path 52 and the second transport path 54.

As illustrated in FIG. 2, the housing 50 includes a projection wall and a cover portion. The projection wall projects from an upper end of a side wall that is the peripheral wall defining the first transport path 52 to a side opposite to the first partition wall 56*a* and the second partition wall 56*b* as viewed from the front side. The cover portion covers the peripheral wall and the projection wall from above. A roller chamber 55 is formed between the projection wall and the cover portion. In the roller chamber 55, the developing roller 42 which will be described later is disposed. The roller chamber 55 is disposed above the first transport path 52. The housing 50 has an opening 51 that allows the developing roller 42 to face the photoconductor drum 32.

As illustrated in FIG. 3, the first partition wall 56*a* and the second partition wall 56*b* are separated from each other in the apparatus depth directions with a first connection port 58*a* being interposed therebetween. The first partition wall 56*a* is separated from an end wall (the peripheral wall) at the −D side with a second connection port 58*b* being interposed between the first partition wall 56*a* and the end wall in the apparatus depth directions. In other words, the first connection port 58*a* and the second connection port 58*b* are separated from each other in the apparatus depth directions with the first partition wall 56*a* being interposed therebetween. The first partition wall 56*a* is an example of a partition wall. The first connection port 58*a* and the second connection port 58*b* connect the first transport path 52 and the second transport path 54.

As illustrated in FIG. 2, the developing roller 42 is a roller-shaped member. The developing roller 42 is disposed in the roller chamber 55 above the first transport path 52 and faces the photoconductor drum 32 with the opening 51 being interposed between the developing roller 42 and the photoconductor drum 32. That is, the developing roller 42 is disposed above the first transport member 60 provided in the first transport path 52. Accordingly, the first transport member 60 (which will be described later) is required to have not only a transport force in the apparatus depth directions but also a transport force to lift the developer G towards the developing roller 42 above the first transport member 60. The developing roller 42 holds, with a magnetic force, the developer G that contains the magnetic carrier and that is accommodated in the first transport path 52, so as to form a layer of the developer G on a surface of the developing roller 42. The developing roller 42 is rotated in such a state to transport the developer G to a position where the developer G faces the photoconductor drum 32. At this time, the developing roller 42 is rotated counterclockwise as viewed from the front side in the exemplary embodiment, as illustrated in FIG. 2. The toner contained in the developer G that is transported to the position where the developer G faces the photoconductor drum 32 by the developing roller 42 adheres to the electrostatic latent image formed on the photoconductor drum 32, whereby the developing device 40 develops the electrostatic latent image into a toner image. When the developing roller 42 and the first transport member 60 are projected onto a plane that is parallel to the apparatus width directions, the developing roller 42 and the first transport member 60 overlap each other at least partially (see FIG. 2). It is noted that in FIG. 3, the developing roller 42 is illustrated at a position separated from the first transport member 60 in the apparatus width directions in order to illustrate the entire first transport member 60.

As illustrated in FIG. 2, the layer regulating member 44 is a roller-shaped member and is disposed on the +W side of the developing roller 42 and on the +H side of the first transport member 60. The layer regulating member 44 regulates, to a predetermined thickness, the layer of the developer G that is carried by the developing roller 42 and that is to be transported to the position where the developer G faces the photoconductor drum 32. When the layer regulating member 44 and the first transport member 60 are projected to a plane that is parallel to the apparatus width directions, the layer regulating member 44 and the first transport member 60 overlap each other at least partially (see FIG. 2). It is noted that the layer regulating member 44 is omitted in FIG. 3 in order to illustrate the entire first transport member 60.

First Transport Member 60

As illustrated in FIG. 3, the first transport member 60 includes the shaft body 62 and a spiral blade 64. The first transport member 60 is provided in the first transport path 52. The shaft body 62 extends in the apparatus depth directions and is rotatably supported by end walls at a first transport path 52 side. The shaft body 62 has a larger diameter than that of a shaft body 72 of the second transport member 70 which will be described later. In this manner, the first transport member 60 is regarded as a member having a smaller space capable of accommodating the developer G in the first transport path 52 than a space in the second transport path 54. The spiral blade 64 includes two spiral blade bodies that are provided around the shaft body 62 from a portion of the shaft body 62 where the shaft body 62 faces the second partition wall 56*b* to a portion of the shaft body 62 where the shaft body 62 faces the second connection port 58*b*. The two spiral blade bodies extend in the apparatus depth directions. In the exemplary embodiment, when the shaft body 62 is rotated clockwise as viewed from the front side, the spiral blade 64 supplies the developer G accommodated in the first transport path 52 to the developing roller 42 while transporting the developer G in a direction extending from the first connection port 58*a* towards the second connection port 58*b* (that is, towards the −D side).

In the exemplary embodiment, an outer diameter of the two spiral blades constituted by the spiral blade 64, that is, a blade diameter, is a predetermined diameter D1. A pitch of the spiral blade 64 is a predetermined pitch P1. Accordingly, the spiral blade 64 transports a predetermined amount of the developer G from a portion where the spiral blade 64 faces the second connection port 58*b* to a portion where the spiral blade 64 faces the first connection port 58*a*. In other words, the first transport member 60 that transports the developer G has the same transport force, which is provided by the spiral blade 64, in the apparatus depth directions. In the present disclosure, the term "transport force" refers to an amount of the developer G per pitch of the spiral blade that is transported per rotation of the transport member [g/rotation]. That is, a transport force of the first transport member 60 at the portion of the transport member 60 where the transport member 60 faces the second connection port 58*b* is equal to the transport force of the first transport member 60 at a portion of the first transport member 60 where the first transport member 60 faces the first partition wall 56*a*. Moreover, a transport force of the first transport member 60 at the portion of the first transport member 60 where the first transport member 60 faces the second connection port 58*b* is equal to the transport force of the first transport member 60 at the portion of the first transport member 60 where the first transport member 60 faces the first connection port 58*a*. In other words, the transport force of the first transport member 60 is the same from the portion of the first transport member 60 where the first transport member 60 faces the first connection port 58*a* up to the portion of the first transport member 60 where the first transport member 60 faces the second connection port 58*b*. In the present disclosure, the phrase that "the transport force is the same" refers to that transport forces at two or more portions of a transport member fall within a range of ±10% of an average value of the transport forces. For example, when two portions of a transport member are compared, transport forces at the two portions are the same if the number of spiral blades, pitches, blade diameters, and shaft diameters are the same. It is noted that the phrase "the same" does not refer to that parameters are completely identical, but allow that the parameters are not completely identical due to a dimensional error or a design error.

Second Transport Member 70

As illustrated in FIG. 3, the second transport member 70 includes the shaft body 72, a first spiral blade 74, a second spiral blade 76, and a third spiral blade 78. The second transport member 70 is provided in the second transport path 54. The shaft body 72 extends in the apparatus depth directions and is rotatably supported by end walls at a second transport path 54 side.

Figure 4:
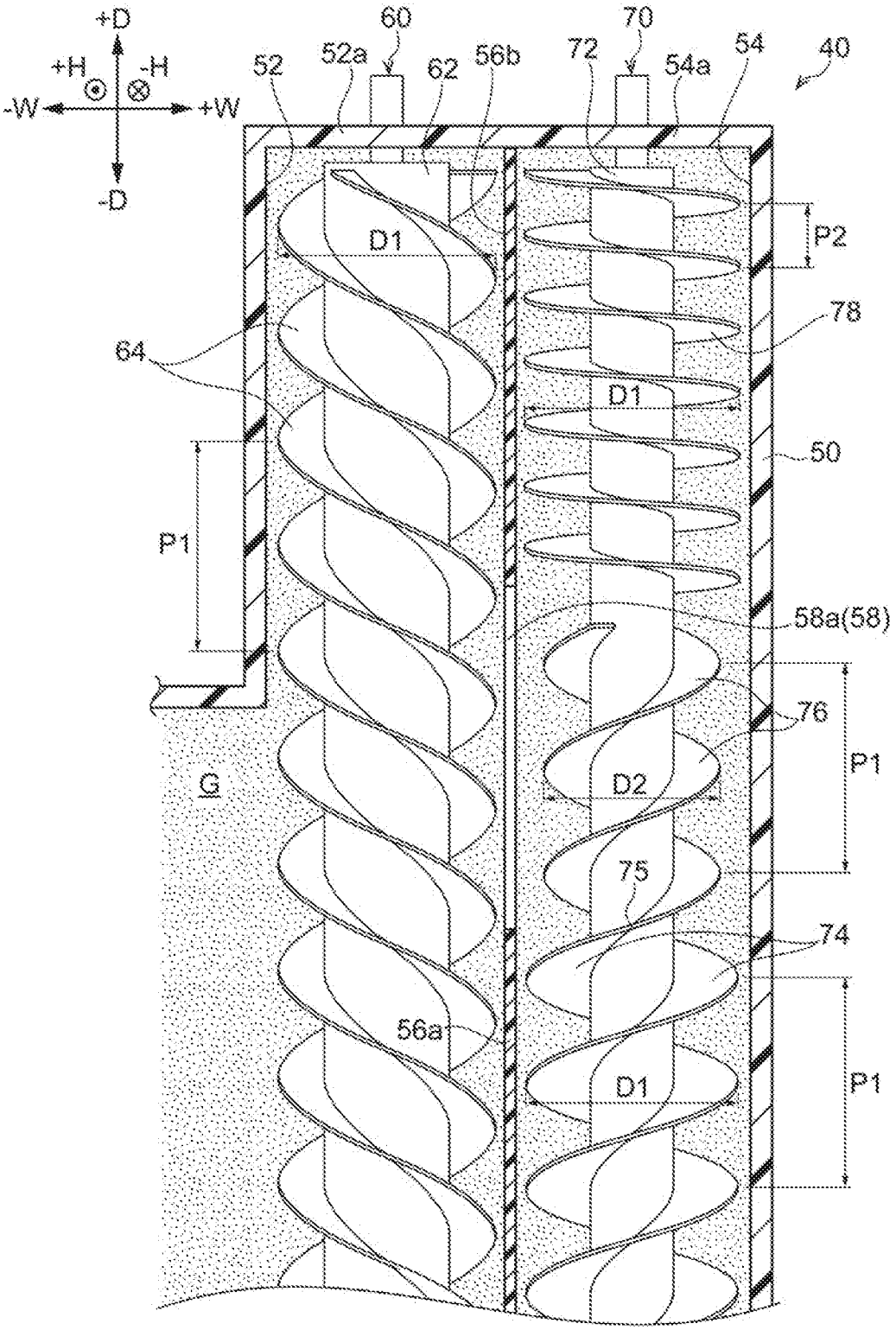
FIG. 4 is an enlarged plan cross-sectional view illustrating a part of the developing device illustrated in FIG. 3.

The first spiral blade 74 includes two spiral blade bodies that are provided around the shaft body 72 from a portion of the shaft body 72 where the shaft body 72 faces the first partition wall 56*a* to a portion of the shaft body 72 where the shaft body 72 faces the second connection port 58*b*. The two spiral blade bodies extend in the apparatus depth directions. In the exemplary embodiment, when the shaft body 72 is rotated clockwise as viewed from the front side, the first spiral blade 74 agitates the developer G around the first spiral blade 74 while transporting the developer G in a direction extending from the second connection port 58*b* towards the first connection port 58*a* (towards the +D side). In the exemplary embodiment, a blade diameter of the first spiral blade 74 is the predetermined diameter D1 as illustrated in FIG. 4. A pitch of the first spiral blade 74 is the predetermined pitch P1. Accordingly, a transport force of the second transport member 70 at a portion of the second transport member 70 where the second transport member 70 faces the second connection port 58*b* is equal to a transport force of the second transport member 70 at a portion of the second transport member 70 where the second transport member 70 faces the first partition wall 56*a*.

The second spiral blade 76 includes two spiral blade bodies that are provided at a portion of the shaft body 72 where the shaft body 72 faces the first connection port 58*a*. The two spiral blade bodies extend in the apparatus depth directions. In the exemplary embodiment, when the shaft body 72 is rotated clockwise as viewed from the front side, the second spiral blade 76 agitates the developer G around the second spiral blade 76 while transporting the developer G in a direction extending from the second connection port 58*b* towards the first connection port 58*a* (towards the +D side).

A blade diameter of the second spiral blade 76 is a predetermined diameter D2. The blade diameter D2 of the second spiral blade 76 is smaller than the blade diameter D1 of the first spiral blade 74. A pitch of the second spiral blade 76 is equal to the pitch P1 of the first spiral blade 74. Accordingly, a transport force of the second spiral blade 76 is smaller than a transport force of the first spiral blade 74. That is, a transport force of the second transport member 70 at a portion of the second transport member 70 where the second transport member 70 faces the first connection port 58*a* is smaller than the transport force of the second transport member 70 at the portion of the second transport member 70 where the second transport member 70 faces the first partition wall 56*a*. The transport force of the second transport member 70 at the portion of the second transport member 70 where the second transport member 70 faces the first connection port 58*a* is smaller than the transport force of the second transport member 70 at the portion of the second transport member 70 where the second transport member 70 faces the second connection port 58*b*.

The second spiral blade 76 is continuously connected to the first spiral blade 74 at a boundary between the first partition wall 56*a* and the first connection port 58*a* in the apparatus depth directions. In the exemplary embodiment, the first spiral blade 74 and the second spiral blade 76 are continuously connected to each other via a stepped portion 75 at the boundary between the first partition wall 56*a* and the first connection port 58*a* in the apparatus depth directions. The stepped portion 75 between the first spiral blade 74 and the second spiral blade 76 may be positioned at any position within a range of +3 [mm] from the boundary in the apparatus depth directions. Further, the stepped portion 75 between the first spiral blade 74 and the second spiral blade 76 may be positioned at the −D side of the boundary within a range of 3 [mm] from the boundary.

The third spiral blade 78 includes a single spiral blade body that is provided at a portion of the shaft body 72 where the shaft body 72 faces the second partition wall 56*b*. The single spiral blade extends in the apparatus depth directions. That is, the third spiral blade 78 is provided at a portion of the shaft body 72 at an opposite side to the first spiral blade 74 with the second spiral blade 76 being interposed between the third spiral blade 78 and the first spiral blade 74. In the exemplary embodiment, when the shaft body 72 is rotated clockwise as viewed from the −D side, the third spiral blade 78 agitates the developer G around the third spiral blade 78 while transporting the developer G in a direction towards the first connection port 58*a* (towards the −D side).

In the exemplary embodiment, a blade diameter of the third spiral blade 78 is equal to the blade diameter D1 of the first spiral blade 74. That is, the blade diameter of the third spiral blade 78 is larger than the blade diameter D2 of the second spiral blade 76. A pitch of the third spiral blade 78 is a predetermined pitch P2. The pitch P2 of the third spiral blade 78 is smaller than the pitch P1 of the first spiral blade 74.

In the exemplary embodiment, the third spiral blade 78 is not continuous with the second spiral blade 76 at a boundary between the second partition wall 56*b* and the first connection port 58*a*.

The first transport member 60 and the second transport member 70 are separately connected to a driving device such as a motor (not illustrated), and are rotated in conjunction with each other. The first transport member 60 and the second transport member 70 rotate in conjunction with each other, so that the developer G flows from the second transport path 54 towards the first transport path 52 via the first connection port 58*a* and flows from the first transport path 52 towards the second transport path 54 via the second connection port 58*b*. Accordingly, a circulation path for the developer G including the first transport path 52, the second connection port 58*b*, the second transport path 54, and the first connection port 58*a* is formed in the developing device 40.

Functions and Effects

Next, functions and effects of the exemplary embodiment of the present disclosure will be described. When the same components or the like as those of the image forming apparatus 10 according to the exemplary embodiment are used in a comparative example in describing the comparative example and a comparative apparatus to be compared with the exemplary embodiment of the present disclosure in the following description, numerals and names of the components and the like are used as they are.

The developing device 40 according to the exemplary embodiment has a configuration in which the transport force of the second transport member 70 at the portion of the second transport member 70 where the second transport member 70 faces the first connection port 58*a* is smaller than the transport force of the second transport member 70 at the portion of the second transport member 70 where the second transport member 70 faces the first partition wall 56*a* (this configuration will be referred to as a first configuration). The developing device 40 having the first configuration and a second configuration is compared with a developing device according to a first comparative example described below.

First Comparative Example

In the developing device according to the first comparative example, a spiral blade having a blade diameter of the predetermined diameter D is provided at a portion of the shaft body 72 of the second transport member 70 where the shaft body 72 faces the first connection port 58*a*. Accordingly, in the first comparative example, the transport force of the second transport member 70 at the portion of the second transport member 70 where the second transport member 70 faces the first connection port 58*a* is equal to the transport force of the second transport member 70 at the portion of the second transport member 70 where the second transport member 70 faces the first partition wall 56*a*. In the first comparative example, the transport force of the second transport member 70 at the portion of the second transport member 70 where the second transport member 70 faces the first connection port 58*a* is equal to the transport force of the second transport member 70 at the portion of the second transport member 70 where the second transport member 70 faces the second connection port 58*b*. Configurations of the first comparative example are the same as those of the exemplary embodiment other than the above-described points.

In a developing device including a circulation path, the developer G transported by the portion of the second transport member 70 where the second transport member 70 faces the first connection port 58*a* is pushed by a spiral blade formed at the portion towards the +D side and flows from the second transport path 54 to the first transport path 52 via the first connection port 58*a*. Therefore, a part of the developer G in the second transport path 54 is likely to accumulate around the first connection port 58*a*.

On the other hand, since the developing device 40 according to the exemplary embodiment has the first configuration, the transport force of the second transport member 70 at the portion of the second transport member 70 where the second transport member 70 faces the first connection port 58*a* is smaller than the transport force of the second transport member 70 at that portion in the first comparative example. Therefore, an amount of the developer G accumulating around the first connection port 58*a* in the second transport path 54 in the developing device 40 having the first configuration is small as compared with the developing device of the first comparative example. Therefore, the developer G is prevented from accumulating around the first connection port 58*a* in the developing device 40 having the first configuration as compared with the developing device of the first comparative example.

The developing device 40 according to the exemplary embodiment has a configuration in which the transport force of the second transport member 70 at the portion of the second transport member 70 where the second transport member 70 faces the first connection port 58*a* is smaller than the transport force of the second transport member 70 at the portion of the second transport member 70 where the second transport member 70 faces the second connection port 58*b* (this configuration will be referred to as the second configuration). Similar to the developing device 40 having the first configuration, the developer G is prevented from accumulating around the first connection port 58*a* in the developing device 40 having the second configuration as compared with the developing device of the first comparative example.

The developing device 40 according to the exemplary embodiment has a configuration in which the blade diameter D2 of the second spiral blade 76 of the second transport member 70 is smaller than the blade diameter D1 of the first spiral blade 74 (this configuration will be referred to as a third configuration). The developing device 40 having the third configuration is compared with a developing device of a second comparative example as described below.

Second Comparative Example

In the developing device according to the second comparative example, the blade diameter of the second spiral blade of the second transport member 70 is the predetermined diameter D1, and the pitch of the second spiral blade is a pitch P3 which is smaller than the pitch P1 of the first spiral blade 74. Accordingly, the transport force of the second spiral blade in the second comparative example is equal to the transport force of the second spiral blade 76 in the exemplary embodiment. Configurations of the second comparative example are the same as those of the exemplary embodiment other than the above-described points.

In a developing device having a circulation path, the developer G around the second spiral blade may scatter in a direction along a centrifugal force applied by the second spiral blade along with the rotation of the second transport member 70. In particular, when the pitch of the second spiral blade is small, if the second spiral blade is rotated so as to enclose the magnetic carrier of the developer Q the enclosed developer G may be scattered without being transported.

On the other hand, since the developing device 40 of the exemplary embodiment has the third configuration, the centrifugal force applied by the second spiral blade 76 is reduced as compared with the developing device of the second comparative example. Therefore, the developer G is prevented from scattering. Since the pitch of the second spiral blade 76 in the developing device 40 according to the exemplary embodiment is larger than the pitch of the second spiral blade in the second comparative example, the second spiral blade 76 is less likely to enclose the magnetic carrier of the developer G. Accordingly, the developer G is prevented from scattering in the developing device 40 according to the exemplary embodiment as compared with the developing device of the second comparative example. It is noted that the second comparative example described above is included in the technical idea of the present disclosure as a modification of the exemplary embodiment.

The developing device 40 according to the exemplary embodiment includes a configuration in which the third spiral blade 78 that transports the developer G towards the first connection port 58*a* is provided at the portion at the opposite side to the first spiral blade 74 with the second spiral blade 76 of the shaft body 72 of the second transport member 70 being interposed between the third spiral blade 78 and the first spiral blade 74, and the blade diameter of the third spiral blade 78 is larger than the blade diameter of the second spiral blade 76 (this configuration will be referred to as a seventh configuration). The developer G in the second transport path 54 is less likely to be transported to a third spiral blade 78 side relative to the first connection port 58*a* in the developing device 40 having the seventh configuration as compared with a configuration in which the blade diameter of the third spiral blade 78 is smaller than the blade diameter of the second spiral blade 76. Therefore, the developer G in the second transport path 54 is prevented from accumulating at the third spiral blade 78 side relative to the first connection port 58*a* in the developing device 40 having the seventh configuration as compared with a configuration in which the third spiral blade transports the developer G towards the +D side.

The developing device 40 according to the exemplary embodiment has a configuration in which the transport force of the first transport member 60 at the portion of the first transport member 60 where the first transport member 60 faces the second connection port 58*b* is equal to the transport force of the first transport member 60 at the portion of the first transport member 60 where the first transport member 60 faces the first partition wall 56*a* (this configuration will be referred to as a fourth configuration). In the developing device having the circulation path, circulation of the developer G in the circulation path is unstable when the transport force of the first transport member 60 at the portion of the first transport member 60 where the first transport member 60 faces the second connection port 58*b* is different from the transport force of the first transport member 60 at the portion of the first transport member 60 where the first transport member 60 faces the first partition wall 56*a*. Therefore, the circulation of the developer G is stable in the developing device 40 having the fourth configuration as compared with a configuration in which the transport force of the shaft body 62 of the first transport member 60 at the portion of the shaft body 62 where the shaft body 62 faces the second connection port 58*b* is smaller than the transport force of the spiral blade 64 at the portion of the spiral blade 64 where the spiral blade 64 faces the first partition wall 56*a*.

The developing device 40 according to the exemplary embodiment has a configuration in which the first transport member 60 is provided with the spiral blade 64 on the shaft body 62 having a larger diameter than the shaft body 72 of the second transport member 70 (this configuration will be referred as a fifth configuration). When the developing device having the circulation path has the fifth configuration, a space of the first transport path 52 capable of accommodating the developer G is smaller than a space of the second transport path 54 capable of accommodating the developer G. Therefore, the developer G is likely to accumulate around the first connection port 58*a*. However, since the developing device 40 according to the exemplary embodiment has the first configuration, an amount of the developer G accumulating around the first connection port 58*a* in the second transport path 54 is small as compared with the developing device of the first comparative example that has the fifth configuration. Therefore, in the developing device 40 having the first and fifth configurations, the developer G is prevented from accumulating around the first connection port 58*a* as compared with the developing device of the first comparative example which has the fifth configuration.

The developing device 40 according to the exemplary embodiment has a configuration in which the developing roller 42 is disposed above the first transport member 60 (this configuration will be referred to as a sixth configuration). When the developing device having the circulation path has the fifth configuration and the sixth configuration, the developer G in the first transport path 52 is lifted in a direction against the gravity by the first transport member 60 and supplied to the developing roller 42. Therefore, the developer G is likely to accumulate around the first connection port 58*a*. However, since the developing device 40 according to the exemplary embodiment has the first configuration, the amount of the developer G accumulating around the first connection port 58*a* in the second transport path 54 is small as compared with the developing device according to the first comparative example that has the fifth configuration and the sixth configuration. Therefore, in the developing device 40 having the first, fifth, and sixth configurations, the developer G is prevented from accumulating around the first connection port 58*a* as compared with the developing device of the first comparative example that has the fifth and sixth configurations.

The developing device 40 according to the exemplary embodiment has a configuration in which the first transport member 60 has the same transport force from the portion of the first transport member 60 where the first transport member 60 faces the first connection port 58*a* up to the portion of the first transport member 60 where the first transport member 60 faces the second connection port 58*b* (this configuration will be referred to as an eighth configuration). Therefore, developing spots are prevented in the developing device 40 having the eighth configuration as compared with a configuration in which the transport force of the shaft body 62 of the first transport member 60 at the portion of the shaft body 62 where the shaft body 62 faces the second connection port 58*b* is smaller than the transport force of the shaft body 62 at the portion where the shaft body 62 faces the first connection port 58*a*.

In addition, the image forming apparatus 10 including the developing device 40 according to the exemplary embodiment prevents image spots in an image formed on the sheet member P due to the developer G accumulating around the first connection port 58*a* as compared with an image forming apparatus including the developing device of the first comparative example.

As described above, the specific exemplary embodiment of the present disclosure has been described in detail. It is noted that the present disclosure is not limited to the above-described exemplary embodiment. Various modifications, changes, and improvements may be made within the scope of the technical idea of the present disclosure.

For example, in the exemplary embodiment, the first spiral blade 74 and the second spiral blade 76 are continuously connected via the stepped portion 75 at the boundary between the first partition wall 56*a* and the first connection port 58*a* in the apparatus depth directions. However, the first spiral blade 74 and the second spiral blade 76 may be continuously connected via a gradual change portion in the apparatus depth direction. The gradual change portion is a spiral blade that is provided between the first spiral blade 74 and the second spiral blade 76 and has a blade diameter changing gradually from D1 to D2. A boundary between the second spiral blade 76 and the gradual change portion may be positioned at any position within a range of +3 mm from the boundary between the first partition wall 56*a* and the first connection port 58*a*. The boundary between the second spiral blade 76 and the gradual change portion may be positioned within a range of 3 mm at the −D side from the boundary between the first partition wall 56*a* and the first connection port 58*a*.

According to the exemplary embodiment, the second transport member 70 includes the third spiral blade 78 that has a larger blade diameter than that of the second spiral blade 76 and that transports the developer G towards the first connection port 58*a*. Alternatively, the second transport member 70 may not include the third spiral blade 78 that is provided at a portion at an opposite side to the first spiral blade 74 with the second spiral blade 76 being interposed between the third spiral blade 78 and the first spiral blade 74. The third spiral blade 78 may have a smaller blade diameter than that of the second spiral blade 76. The third spiral blade 78 may transport the developer G in a direction opposite to the direction extending from the first connection port 58*a* towards the second connection port 58*b*.

According to the exemplary embodiment, the first transport member 60 includes the spiral blade 64 that has the predetermined blade diameter D1 and the predetermined pitch P1, and that is provided around the shaft body 62. Alternatively, the spiral blade 64 may have neither the predetermined blade diameter nor the predetermined pitch. According to the exemplary embodiment, the first transport member 60 has the same transport force from the portion of the first transport member 60 where the first transport member 60 faces the first connection port 58*a* up to the portion of the first transport member 60 where the first transport member 60 faces the second connection port 58*b*. Alternatively, the transport force of the first transport member 60 at the portion of the first transport member 60 where the first transport member 60 faces the second connection port 58*b* may be different from the transport force of the first transport member 60 at the portion of the first transport member 60 where the first transport member 60 faces the first partition wall 56*a*, or may be different from the transport force of the first transport member 60 at the portion of the first transport member 60 where the first transport member 60 faces the first connection port 58*a*. That is, the first transport member 60 may not have the same transport force from the portion of the first transport member 60 where the first transport member 60 faces the first connection port 58*a* up to the portion of the first transport member 60 where the first transport member 60 faces the second connection port 58*b*.

According to the exemplary embodiment, the shaft body 62 of the first transport member 60 has a larger diameter than that of the shaft body 72 of the second transport member 70. Alternatively, the shaft body 62 of the first transport member 60 may have a smaller diameter than that of the shaft body 72 of the second transport member 70.

According to the exemplary embodiment, the developing roller 42 is disposed above the first transport member 60. Alternatively, the developing roller 42 may be disposed beside the first transport member 60.

An example in which the present disclosure is applied to a developing device of an electrophotographic process as a powder transport apparatus is described in the above-described exemplary embodiment. It is noted that the present disclosure is not limited thereto and may be applied to applications other than developing.

For example, a powder coating device may be implemented by using a developer of the above-described exemplary embodiment as coating powder. Specifically, the developing device according to the above-described exemplary embodiment is used as a powder coating head using an electrostatic powder coating method, and a conductive sheet-shaped medium is transported while being brought close to the powder coating head. A bias voltage is applied between the powder coating head and the conductive sheet-like medium, so that a charged coating powder (for example, heat curing toner) is coated onto the sheet-shaped medium. Thereafter, a surface of the sheet-shaped medium is coated with the powder when the sheet-shaped medium is heated.

The present disclosure may be applied to other manufacturing devices using powder. For example, the present disclosure may be applied to a device that transports carbon black used in manufacturing in a manufacturing device that manufactures an electrode body for a secondary battery.

In addition, application of powder is not limited, and the powder may be powder for use in medicine, powder for use in food, or the like. Alternatively, a form of a device is not limited as long as the device is a device using powder such as a manufacturing device, a processing device, and an inspection device.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A powder transport apparatus comprising:

a housing comprising a first transport path and a second transport path that are separated by a partition wall extending in one direction, the first transport path and the second transport path being connected to each other by a first connection port and a second connection port, the first connection port and the second connection port being separated in the one direction with the partition wall interposed therebetween;

a first transport member provided in the first transport path, the first transport member being configured to transport powder in a direction extending from the first connection port towards the second connection port; and a second transport member provided in the second transport path, the second transport member being configured to transport the powder in a direction extending from the second connection port towards the first connection port, wherein a transport force of the second transport member at a portion of the second transport member where the second transport member faces the first connection port is smaller than a transport force of the second transport member at a portion of the second transport member where the second transport member faces the partition wall, wherein the powder transport apparatus is configured to supply powder to a roller which uses the powder, and the first transport path is disposed closer to a side of the powder transport apparatus configured to be adjacent the roller than the second transport path.

2. The powder transport apparatus according to claim 1, wherein the second transport member comprises a shaft body extending in the one direction, a first spiral blade provided at a portion of the shaft body where the shaft body faces the partition wall, and a second spiral blade provided at a portion of the shaft body where the shaft body faces the first connection port, and the second spiral blade has a blade diameter smaller than that of the first spiral blade.

3. The powder transport apparatus according to claim 2, wherein the second transport member further comprises a third spiral blade provided at a portion of the shaft body at an opposite side to the first spiral blade with the second spiral blade being interposed between the third spiral blade and the first spiral blade, the third spiral blade has a blade diameter larger than that of the second spiral blade, and the third spiral blade is configured to transport the powder towards the first connection port.

4. The powder transport apparatus according to claim 3, wherein the first transport member comprises a spiral blade provided on the shaft body having a larger diameter than that of the shaft body of the second transport member.

5. The powder transport apparatus according to claim 4, wherein the roller is a developing roller provided above the first transport member, the developing roller being configured to be supplied with the powder from the first transport member.

6. The powder transport apparatus according to claim 3, wherein a transport force of the first transport member at a portion of the first transport member where the first transport member faces the second connection port is equal to a transport force of the first transport member at a portion of the first transport member where the first transport member faces the partition wall.

7. The powder transport apparatus according to claim 2, wherein a transport force of the first transport member at a portion of the first transport member where the first transport member faces the second connection port is equal to a transport force of the first transport member at a portion of the first transport member where the first transport member faces the partition wall.

8. The powder transport apparatus according to claim 6, wherein the first transport member comprises a spiral blade provided on the shaft body having a larger diameter than that of the shaft body of the second transport member.

9. The powder transport apparatus according to claim 8, wherein the roller is a developing roller provided above the first transport member, the developing roller being configured to be supplied with the powder from the first transport member.

10. The powder transport apparatus according to claim 7, wherein the first transport member comprises a spiral blade provided on the shaft body having a larger diameter than that of the shaft body of the second transport member.

11. The powder transport apparatus according to claim 10, wherein the roller is a developing roller provided above the first transport member, the developing roller being configured to be supplied with the powder from the first transport member.

12. The powder transport apparatus according to claim 2, wherein the first transport member comprises a spiral blade provided on the shaft body having a larger diameter than that of the shaft body of the second transport member.

13. The powder transport apparatus according to claim 12, wherein the roller is a developing roller provided above the first transport member, the developing roller being configured to be supplied with the powder from the first transport member.

14. The powder transport apparatus according to claim 1, wherein the first transport member comprises a spiral blade provided on a shaft body having a larger diameter than that of the shaft body of the second transport member.

15. The powder transport apparatus according to claim 14, wherein the roller is a developing roller provided above the first transport member, the developing roller being configured to be supplied with the powder from the first transport member.

16. The powder transport apparatus according to claim 14, wherein the first transport member has the same transport force from a portion of the first transport member where the first transport member faces the first connection port up to a portion of the first transport member where the first transport member faces the second connection port.

17. A powder transport apparatus comprising:

a housing comprising a first transport path and a second transport path that are separated by a partition wall extending in one direction, the first transport path and the second transport path being connected to each other by a first connection port and a second connection port, the first connection port and the second connection port being separated in the one direction with the partition wall interposed therebetween;

a first transport member provided in the first transport path, the first transport member being configured to transport powder in a direction extending from the first connection port towards the second connection port; and a second transport member provided in the second transport path, the second transport member being configured to transport the powder in a direction extending from the second connection port towards the first connection port, wherein a transport force of the second transport member at a portion of the second transport member where the second transport member faces the first connection port is smaller than a transport force of the second transport member at a portion of the second transport member where the second transport member faces the second connection port, wherein the powder transport apparatus is configured to supply powder to a roller which uses the powder, and the first transport path is disposed closer to a side of the powder transport apparatus configured to be adjacent the roller than the second transport path.

18. A powder transport apparatus comprising:

a housing comprising a first transport path and a second transport path that are separated by a partition wall extending in one direction, the first transport path and the second transport path being connected to each other by a first connection port and a second connection port, the first connection port and the second connection port being separated in the one direction with the partition wall interposed therebetween;

first transport means provided in the first transport path, the first transport means for transporting powder in a direction extending from the first connection port towards the second connection port; and second transport means provided in the second transport path, the second transport means for transporting the powder in a direction extending from the second connection port towards the first connection port, wherein a transport force of the second transport means at a portion of the second transport means where the second transport means faces the first connection port is smaller than a transport force of the second transport means at a portion of the second transport means where the second transport means faces the partition wall, wherein the powder transport apparatus is configured to supply powder to a roller which uses the powder, and the first transport path is disposed closer to a side of the powder transport apparatus configured to be adjacent the roller than the second transport path.

* * * * *